US009675118B2

(12) United States Patent
Chen

(10) Patent No.: US 9,675,118 B2
(45) Date of Patent: Jun. 13, 2017

(54) ELECTRONIC CIGARETTE AND ATOMIZER ASSEMBLY MOUNTING BASE THEREOF

(71) Applicant: Shenzhen Smoore Technology Limited, Shenzhen, Guangdong (CN)

(72) Inventor: Zhiping Chen, Shenzhen (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 164 days.

(21) Appl. No.: 14/409,492

(22) PCT Filed: Aug. 29, 2014

(86) PCT No.: PCT/CN2014/085621

§ 371 (c)(1),
(2) Date: Dec. 19, 2014

(87) PCT Pub. No.: WO2016/029471

PCT Pub. Date: Mar. 3, 2016

(65) Prior Publication Data

US 2016/0128386 A1 May 12, 2016

(51) Int. Cl.

| | |
|---|---|
| ***A24F 47/00*** | (2006.01) |
| ***H05B 3/00*** | (2006.01) |
| ***H05B 3/04*** | (2006.01) |
| ***H05B 3/06*** | (2006.01) |
| ***H05B 3/44*** | (2006.01) |

(52) U.S. Cl.

CPC ..... *A24F 47/008* (2013.01); *H05B 3/00* (2013.01); *H05B 3/04* (2013.01); *H05B 3/06* (2013.01); *H05B 3/44* (2013.01); *H05B 2203/014* (2013.01); *H05B 2203/021* (2013.01); *H05B 2203/022* (2013.01)

(58) Field of Classification Search

CPC ..... A24F 47/008
USPC ..... 131/329
See application file for complete search history.

(56) References Cited

U.S. PATENT DOCUMENTS

2013/0319438 A1* 12/2013 Liu ..... A24F 47/008 131/329

FOREIGN PATENT DOCUMENTS

CN 203168030 U * 9/2013 ..... A24F 47/00

OTHER PUBLICATIONS

International Search Report of PCT Patent Application No. PCT/CN2014/085621 issued on Jun. 1, 2015.

* cited by examiner

*Primary Examiner* — Alison L Hindenlang
*Assistant Examiner* — Jamel M Nelson

(57) ABSTRACT

The present invention provides an electronic cigarette and an atomizer assembly mounting base thereof. The atomizer assembly mounting base used for an electronic cigarette, includes an elastic body engaging with an inner sidewall of a housing of the electronic cigarette, and a rigid support for supporting an atomizer assembly of the electronic cigarette. The elastic body defines a first central hole, and the rigid support is inserted into the first central hole. By virtue of the combination of the elastic body and the rigid support, on one hand, two spaces divided by the atomizer assembly mounting base in the housing of the electronic cigarette are not isolated completely, on the other hand, the rigid support provides better support for the atomizer of the electronic cigarette.

18 Claims, 10 Drawing Sheets

ELECTRONIC CIGARETTE AND ATOMIZER ASSEMBLY MOUNTING BASE THEREOF

BACKGROUND

1. Technical Field

The present disclosure relates to smokers products, and more particularly relates to an electronic cigarette and an atomizer assembly mounting base thereof.

2. Description of Related Art

The electronic cigarette is also known as a virtual cigarette or an electronic atomizer. As a substitute for cigarette, the electronic cigarette is usually used for smoking cessation. The appearance and taste of electronic cigarette are similar to those of the conventional cigarette, while it does not contain tar, suspended particles and other harmful ingredients as the conventional cigarette. The related electronic cigarette includes a cylindrical housing, an atomizer assembly, a battery assembly, a liquid solution reservoir, a mouthpiece, and an end cover. The atomizer assembly, the battery assembly and the liquid solution reservoir are housed in the cylindrical housing. The mouthpiece and the end cover are respectively mounted to two opposite ends of the cylindrical housing. The related electronic cigarette functions as a substitute of tobacco in a certain extend. However, the atomizer assembly mounting base for mounting the atomizer assembly of the related electronic cigarette is generally made of rigid plastic injection molding, a sealing effect between the peripheral of the atomizer assembly mounting base and the housing is poor, and two spaces divided by the atomizer assembly mounting base in the housing are not isolated completely, which may result in leakage of liquid.

SUMMARY

Embodiments of the present invention relate to an electronic cigarette and an atomizer assembly mounting base thereof to overcome the above-mentioned disadvantage.

The atomizer assembly mounting base used for an electronic cigarette, includes an elastic body engaging with an inner sidewall of a housing of the electronic cigarette, and a rigid support for supporting an atomizer assembly of the electronic cigarette. The elastic body defines a first central hole, and the rigid support is inserted into the first central hole.

Wherein, in some embodiments, the elastic body includes a top end surface, a bottom end surface opposite to the top end surface, and a sidewall surface connecting the top end surface with the bottom end surface, the first central hole extends from the top end surface to the bottom end surface; the rigid support includes a first inserting portion, a main portion, a second inserting portion, and a second central hole; the first inserting portion and the second inserting portion are coupled to a top side and a bottom side of the main portion respectively, and are inserted into the atomizer assembly and the elastic body respectively; the second central hole extends through the first inserting portion, the main portion, and the second inserting portion in sequence; the second inserting portion is inserted into the first central hole from the top end surface.

Wherein, a plurality of annular flange protrudes radially and outwardly from the sidewall of the elastic body, each annular flange extends along the contour of the sidewall, two adjacent annular flanges are spaced apart from each other, the maximum outer diameter of the annular flange is greater than the inner diameter of the housing; the inner surface of the first central hole is provided with at least two annular protrusions, the annular protrusions are spaced apart, the annular protrusions tightly abut against the sidewall of the second embedding potion.

Wherein, in some embodiments, the bottom end surface of the elastic body recesses to define a plurality of guiding slots, the guiding slots surround the first central hole and are arranged radially, each guiding slot extends from the sidewall surface of the elastic body to the first central hole.

Wherein, the bottom end surface recesses to define an annular step surrounding the first central hole, the annular step is coplanar with the bottom of the guiding slots; a hook-shaped limiting member is arranged adjacent to the distal end of the second inserting portion, the limiting member is arranged along the contour of the second inserting portion, the diameter of the limiting member is greater than the diameter of the first central hole of the elastic body, the limiting portion hooks the annular step of the bottom end surface of the elastic body.

Wherein, in some embodiments, the middle of the sidewall of the second inserting portion recesses to define a groove, the groove extends from the end surface of the second inserting portion to the top end surface of the limiting portion in a direction parallel to the axis of the second inserting portion, and extends laterally and upwardly through the second inserting portion and the limiting portion.

Wherein, the front end of the limiting portion includes a tapered guiding portion, for guiding the limiting portion to pass through the first central hole.

Wherein, in some embodiments, the bottom end surface further recesses to define a number of accommodating slots for accommodating glue, the accommodating slots correspond to the guiding slots, each accommodating slot intersects with the corresponding guiding slot, the depth of each accommodating slot is greater the depth of the corresponding guiding slot.

Wherein, in some embodiments, the elastic body further defines a number of holes, the number of the holes is equal to the number of the accommodating slots, and the holes correspond to the accommodating slots respectively; the hole is a blind hole, and extends from the bottom of the receiving portion in a direction toward the bottom of the corresponding accommodating slot, a stopping wall is formed between the bottom of the hole and the bottom of the corresponding accommodating slot.

Wherein, in some embodiments, each hole is cylindrical, and comprises a first portion, a second portion, and a connecting portion for communicating the first portion with the second portion, the diameter of the first portion is greater than that of the second portion, the stopping wall is arranged between the second portion and the corresponding accommodating slot.

Wherein, the main portion includes a first end surface, a second end surface opposite to the first end surface, the center of the first end surface recesses to define an accommodating portion, the first inserting portion protrudes from the bottom of the accommodating portion, the second inserting portion protrudes from the centre of the second end surface.

Wherein, the main body includes a first section, a second section, and a third section, the first section, the second section and the third section are arranged coaxially between the first end surface and the second end surface, an annular step is formed between the first section and the second section; the center of the top end surface of the soft body recesses to define an accommodating portion, the third section is inserted into the accommodating portion, the second section tightly abuts against the top end surface.

Wherein, the rigid support includes two positioning posts, the positioning posts are connected to the circumference of the second end surface surrounding the second central hole, the positioning posts are respectively arranged at opposite sides of the second inserting portion; the rigid support defines two receiving holes, the receiving holes are arranged at opposite sides of the second inserting portion, the receiving holes are arranged on the circumference of the second end surface surrounding the second central hole and are evenly spaced apart from each other.

the electronic cigarette includes a cylindrical housing, a mouthpiece, an end cover, a reservoir, a power supply assembly, an atomizer assembly, and each one of the above mentioned atomizer assembly mounting base. The mouthpiece and the end cover two opposite ends of the housing respectively; the atomizer assembly mounting base, the atomizer assembly, the reservoir, and the power supply assembly are housed in the housing; the atomizer assembly mounting base is arranged in the middle of the housing; the atomizer assembly is mounted to the atomizer assembly mounting base and is arranged between the mouthpiece and the atomizer assembly mounting base; the reservoir is disposed at the peripheral of the atomizer assembly; the power supply assembly is arranged between the atomizer assembly mounting base and the end cover and is electrically connected to the atomizer assembly.

Wherein, in some embodiments, the atomizer assembly includes an air flowing pipe, a wick, a heating member, and a positioning sleeve; the inlet of the air flowing pipe sleeve on the rigid support of the atomizer assembly mounting base, the outlet of the air flowing pipe faces the central through hole of the mouthpiece, the sidewall of the air flowing pipe defines two opposite holes and a cut communicating with the cut; the wick extends through the holes, the positioning sleeve sleeves a portion of the air flowing pipe corresponding to the cut.

The present invention's beneficial effect: by virtue of the combination of the elastic body and the rigid support, on one hand, two spaces divided by the atomizer assembly mounting base in the housing of the electronic cigarette are not isolated completely, on the other hand, the rigid support provides better support for the atomizer of the electronic cigarette.

BRIEF DESCRIPTION OF THE DRAWINGS

In combination drawings with embodiments below to further illustrate the present invention, in the drawings.

DETAILED DESCRIPTION

Figure 1:
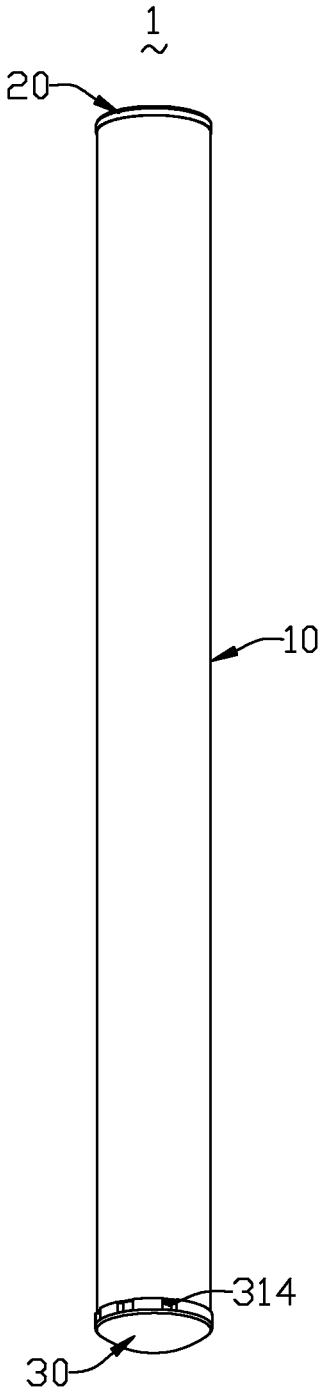
FIG. 1 is a perspective view of an electronic cigarette in some embodiments of the present invention.
Figure 2:
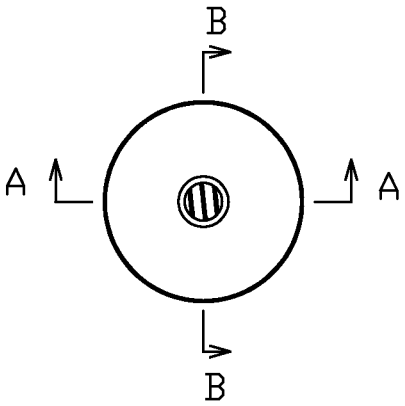
FIG. 2 is a top view of the electronic cigarette shown in FIG. 1.

In combination with drawings, illustrative embodiments of the disclosure are below. The following explanation provides specific details for a thorough understanding of and enabling description for these embodiments.

FIGS. 1-4, illustrate an electronic cigarette 1 in some embodiments. The electronic cigarette 1 may include a cylindrical housing 10, a mouthpiece 20, an end cover 30, an atomizer assembly mounting base 40, an atomizer assembly 50, a reservoir 60 for storing liquid solution, a power supply assembly 70, an air switch 80, and a light emitting unit 90.

The mouthpiece 20 and the end cover 30 are mounted to two opposite ends of the housing 10 respectively. The atomizer assembly mounting base 40, the atomizer assembly 50, the reservoir 60 and the power supply assembly 70 are disposed within the housing 10. The atomizer assembly mounting base 40 is arranged in the middle of the housing 10. The atomizer assembly 50 is mounted to the atomizer assembly mounting base 40 and is located between the atomizer assembly mounting base 40 and the mouthpiece 20. The reservoir 60 is mounted to the atomizer assembly mounting base 40 and wraps the atomizer assembly 50. The power supply assembly 70 is arranged between the atomizer assembly mounting base 40 and the end cover 30. The power supply assembly 70 is electrically connected to the atomizer assembly 50. The air switch 80 is disposed within the end cover 30. The light emitting unit 90 is mounted on the air switch 80. The air switch 80 and the light emitting unit 90 are electrically connected to the power supply assembly 70.

The housing 10 in some embodiments may be substantially cylindrical. The housing 10 is made of elastic material, such as elastic plastic, whereby enabling deformation when extruded radially by the user, to simulate a touch sensation of a cigarette. It is noteworthy that the housing 10 may be rectangular, oval, and so on. The housing 10 may also be made of rigid material, such as steel.

Figure 5:
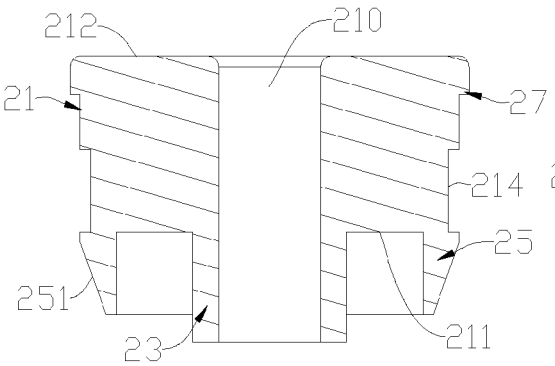
FIG. 5 is an enlarged cross-sectional view of the mouthpiece of the electronic cigarette shown in FIG. 3.
Figure 6:
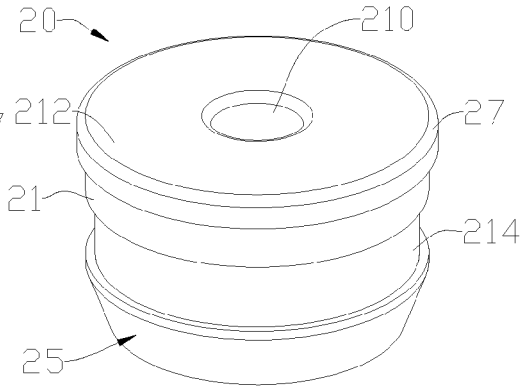
FIG. 6 is a perspective view of the mouthpiece of the electronic cigarette shown in FIG. 3.

Referring to FIGS. 5 and 6, the mouthpiece 20 in some embodiments may be made of elastic material, such as silica gel rubber. The mouthpiece 20 may include a main body 21, a ring 23, a guiding boss 25 and a flange 27. The main body 21 is substantially cylindrical. The diameter of the main body 21 is slightly greater than the diameter of a hole defined in an end of the housing 10 for receiving the mouthpiece 20, whereby enabling the mouthpiece 20 to tightly engage with the housing 10 by an interference fit, for avoiding leakage of the liquid solution via the clearance between the housing 10 and the mouthpiece 20.

The main body 21 in some embodiments may include an inner end surface 211 and an outer end surface 212. The inner end surface 211 is opposite to the outer end surface 212. The main body 21 defines a central through hole 210. The central through hole 210 extends from the inner end surface 211 to the outer end surface 212. The central through hole 210 allows atomizer generated by the atomizer assembly 50 flowing out of the housing 10. The ring 23 protrudes from the inner end surface 211 and surrounds the central through hole 210, to elongate the distance of the liquid solution flows from the edge of the inner end surface 211 to the central through hole 210, whereby reducing probability of leakage of the liquid solution via the central through hole 210.

In some embodiments, the outer surface of the main body 21 of the mouthpiece 20 may recess radially and inwardly to form a ring groove 214, the ring groove 214 may be to accommodate liquid solution which leakages from the clearance between the inner surface of the housing 10 and the side wall of the main body 21, whereby enhancing the engagement tightness of the mouthpiece 20 and the housing 10. Furthermore, because of the existence of liquid surface tension, the configured ring groove 214 greatly improves the resistance of fluid extends toward the corresponding end of the housing 10, which can significantly reduce the probability of leakage of liquid solution. It should be noteworthy that the number of the ring groove 214 is not limited to one, two or more ring grooves spaced apart may be defined.

The guiding boss 25 extends from the rim of the inner end surface 211 of the main body 21 in a direction adjacent to the atomizer assembly 50. The distal end of the guiding boss 25 defines a substantially tapered guiding surface. Because of the guiding boss 25, the mouthpiece 20 is mounted conveniently, at the same time, the distance of the solution flows from the sidewall of the housing 10 to the central through hole 210, whereby enhancing difficulty of leakage of the solution via the central through hole 210.

Figure 3:
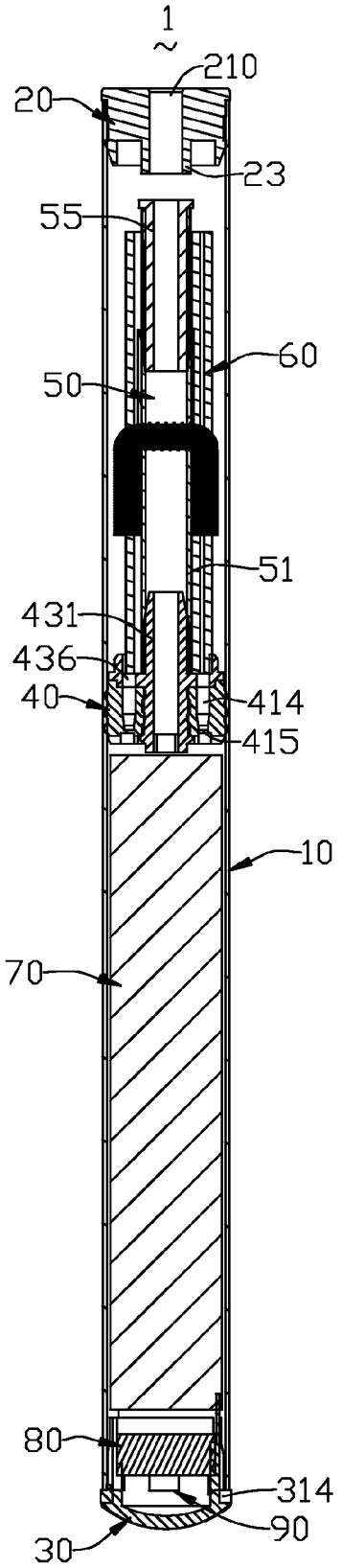
FIG. 3 is a cross-sectional view taken along line A-A of the electronic cigarette shown in FIG. 2; the electronic cigarette includes a mouthpiece, an end cover, an atomizer assembly, a reservoir, an atomizer assembly mounting base, and a light emitting unit.
Figure 4:
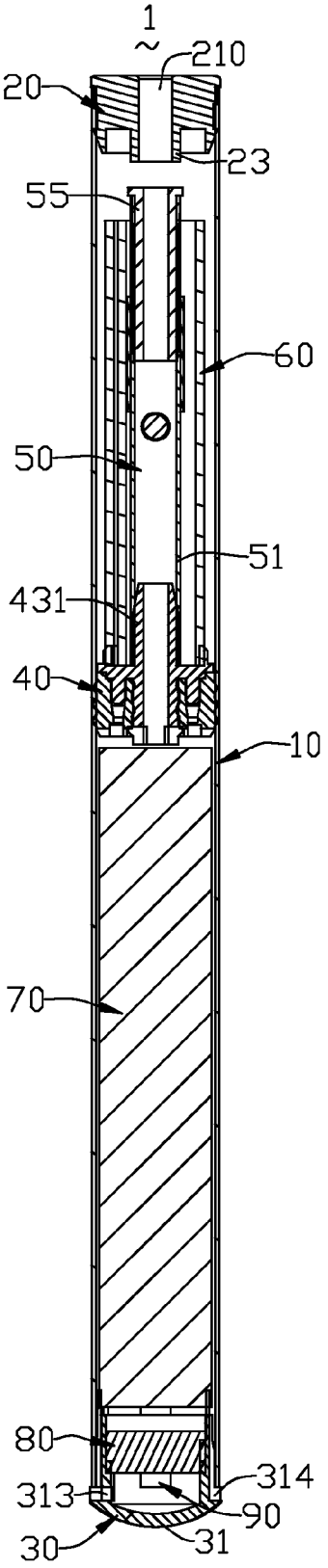
FIG. 4 is a cross-sectional view taken along line B-B of the electronic cigarette shown in FIG. 2.

In some embodiments, the flange 27 may extend radially and outwardly from the side wall of the main body 21 and is coplanar with the outer end surface 212. As shown in FIGS. 3 and 4, the outer diameter of the flange 27 is substantially equal to that of the end of the housing 10 where the mouthpiece 20 is mounted. As a result, when the mouthpiece 20 is inserted into the housing 10, the flange 27 abuts tightly against the inner surface of the housing 10. On one hand, the flange 27 is able to prevent the mouthpiece 20 from being inserted excessively into the housing 10, on the other hand, the flange 27 is able to allow the mouthpiece 20 to be easily pulled out.

Figure 7:
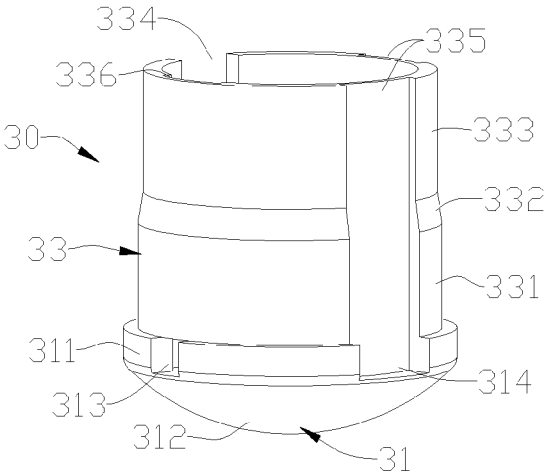
FIG. 7 is a perspective view of the end cover of the electronic cigarette shown in FIG. 3.
Figure 8:
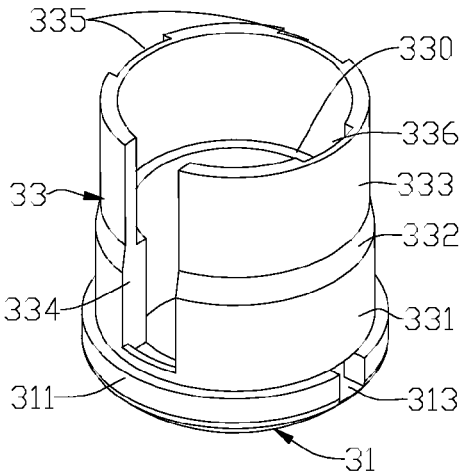
FIG. 8 is a perspective view of the mouthpiece of the electronic cigarette shown in FIG. 3 in another aspect.

Referring to FIGS. 7 and 8, in some embodiments, the end cover 30 may be integrally formed of rigid plastic by injection molding. The end cover 30 may include a bottom wall 31 and a cylindrical sidewall 33 mounted to the bottom wall 31. The bottom wall 31 is adapted to cover the corresponding end of the housing 10, the sidewall 33 is adapted to be tightly inserted into the housing 10, whereby the end cover 30 is mounted to the housing 10.

The bottom wall 31 defines an aperture 313 and an air inlet 314. The aperture 313 extends through the bottom wall 31, to communicate the inner space of the end cover 30 with the outside. The air inlet 314 is defined on the outer surface of the bottom wall 31, whereby allowing air to enter into the housing 10. In some embodiments, the bottom wall 31 may include an annular enclosure 311 and a cover plate 312 coupled to the annular enclosure 311. The aperture 313 and the air inlet 314 are defined on the annular enclosure 311. The outer diameter of the annular enclosure 311 is substantially equal to that of the end of the housing 10 where the end cover 30 is mounted. When the end cover 30 is inserted into the housing 10, the annular enclosure 311 tightly abuts against the inner surface of the housing 10. The cover plate 312 includes at least a transparent portion, whereby enabling light emitted by the light emitting unit 90 transmitting therethrough to simulate firework effect of burning cigarette. The transparent portion can be a top area of the cover plate 312, and can also be the whole of the cover plate 312. The cover plate 312 in the embodiment is substantially hemispherical, to simulate firework effect of burning cigarette more real and beautiful.

Figure 23:
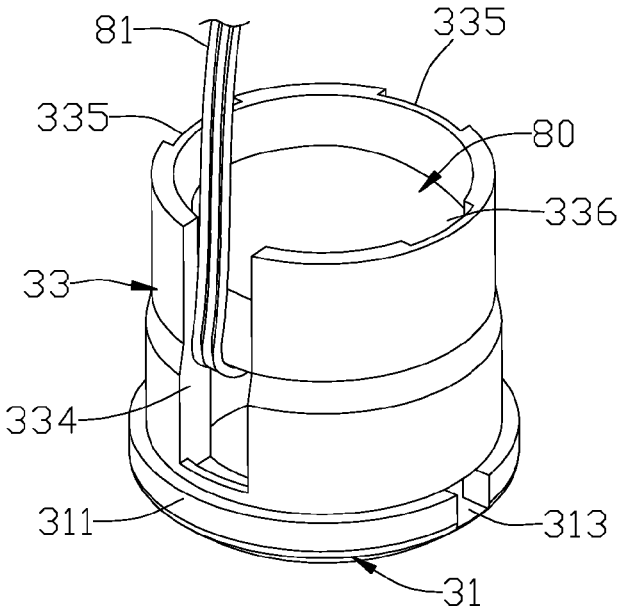
FIG. 23 is a perspective view of the end cover shown in FIG. 3 after the light emitting unit is mounted thereto.

In some embodiments, the sidewall 33 defines a cutout 334. The cutout 334 extends through the inner wall and the outer wall of the sidewall 33. Referring to FIG. 23, wires 81 pass through the cutout 334 to electrically connect the air switch 80 to the power supply assembly 70. The outer wall of the sidewall 33 further defines an outer guiding groove 335. The outer guiding groove 335 extends from an end of the sidewall 33 away from the cover plate 312 to the bottom wall 31. The outer guiding groove 335 communicates with the air inlet 314, whereby enabling air passing through the air inlet 314 and the outer guiding groove 335 in sequence and further entering into the housing 10 to take smoke generated by the atomizer assembly 50 away.

The sidewall 33 in some embodiments may further define a step 330. The step 330 is arranged at the inner surface of the sidewall 33. The air switch 80 is accommodated within the end cover 30 and is mounted to the step 330. The light emitting unit 90 is mounted to a side of the air switch 80 facing the bottom wall 31. An internal space between the air switch 80 and the bottom wall 31 communicates with the outside with the aperture 313, to keep the internal and external pressure in a balance. Air which entries into the end cover 30 via the aperture 313, changes the pressure below the step 330, and the air switch 80 is actuated by the variation of air pressure.

Referring to FIGS. 7 and 8 again, the sidewall 33 in some embodiments may be substantially step-cylindrical. The sidewall 33 includes a first column 331, a second column 333, and a transmission portion 332 coupling the first column 331 with the second column 333. The diameter of the first column 331 is greater than that of the second column 333. The first column 331 extends from the annular enclosure 311 of the bottom wall 31. The outer diameter of the first column 331 is slightly greater than the inner diameter of the first end of the housing 10, but is less than the outer diameter of the first end, whereby enabling the end cover 30 engaging with the housing 10 by an interference fit. The outer diameter of the second column 333 is less than the inner diameter of the first end. The second column 333 and the transmission portion 332 cooperatively guide the installation of the side wall 33.

The step 330 in some embodiments may arranged at the junction of the transmission portion 332 and the second column 333, to enhance the strength for supporting the air switch 80, and to protect the installing of the end cover 30 from being hindered. The cutout 334 extends from an end of the first column 331 away from the bottom wall 31 to the bottom wall 31, whereby enabling wires electrically connected to the air switch 80 to pass therethrough. The outer guiding groove 335 extends from an end of the first column 331 away from the bottom wall 31 to the bottom wall 31, and communicates with the air inlet 314, to allow air entering into the housing 10 by passing through the air inlet 314, the outer guiding groove 335 in sequence. In some embodiments, the inner surface of the sidewall 33 may further define an inner guiding groove 336. The inner guiding groove 336 extends from an end of the first column 331 away from the bottom wall 31 to the bottom wall 31, and communicates with the aperture 313, whereby enabling air to entry into the housing 10 by passing through the aperture 313 and the inner guiding groove 336.

Figure 9:
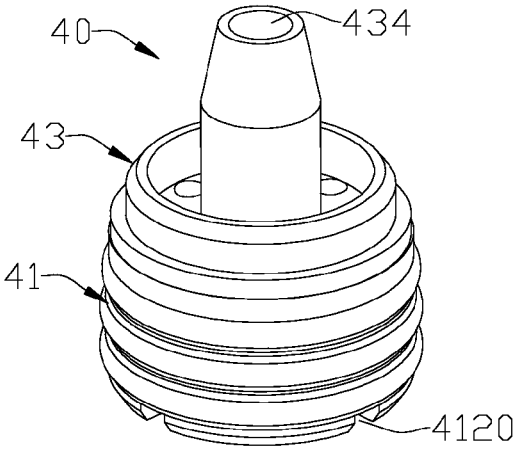
FIG. 9 is a perspective view of the atomizer assembly mounting base of the electronic cigarette shown in FIG. 3.
Figure 10:
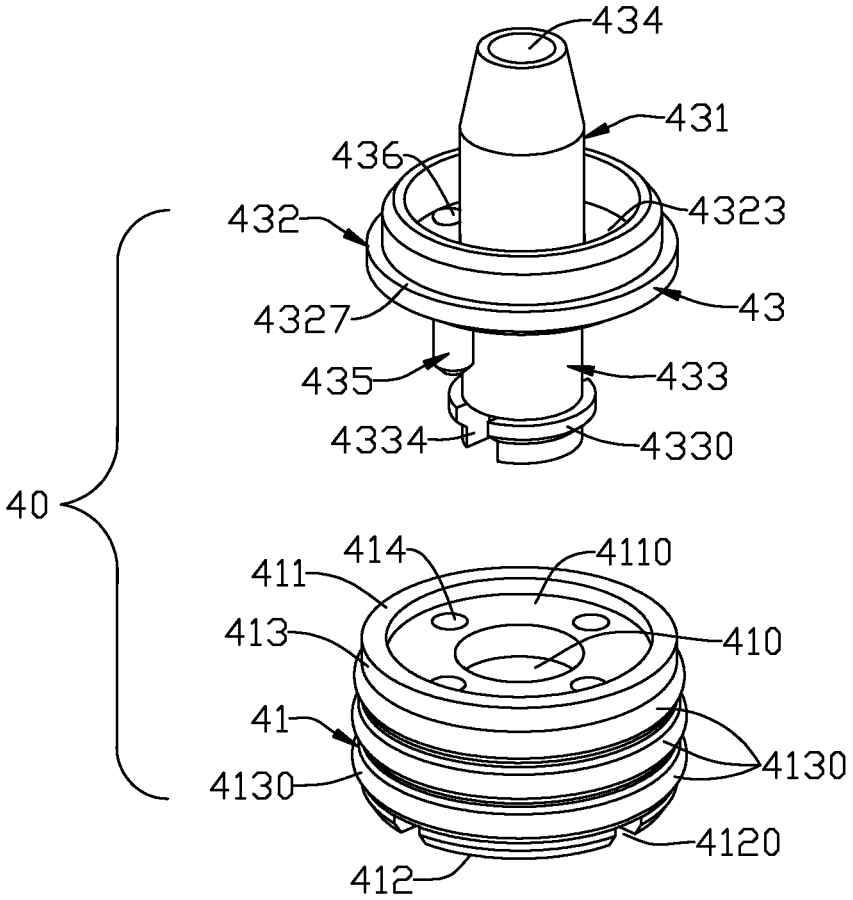
FIG. 10 is an exploded view of the atomizer assembly mounting base of FIG. 9.

Referring to FIGS. 9 and 10, the atomizer assembly mounting base 40 in some embodiments may include an elastic body 41 and a rigid support 43. The elastic body 41 engages with the inner surface of the housing 10. The rigid support 43 is used for mounting the atomizer assembly 50. The center of the elastic body 41 defines a first central hole 410, for allowing the rigid support 43 to be inserted thereinto. By virtue of the assortment of the elastic body 41 and the rigid support 43, spaces in the housing 10 separated by the atomizer assembly mounting base 40 are tightly isolated by the elastic body 41, and the atomizer assembly 50 is better supported by the rigid support 43.

The elastic body 41 in some embodiments may be cylindrical, and may be made of elastic material, such as rubber. The elastic body 41 includes a top end surface 411, a bottom end surface 412 opposite to the top end surface 411, and a sidewall surface 413 connecting the top end surface 411 with the bottom end surface 413. The first central hole 410 extends from the top end surface 411 to the bottom end surface 412. The inner surface of the first central hole 410 is provided with at least two annular protrusions 4101 (see FIG. 12). The annular protrusions 4101 are spaced apart. When the second inserting portion 433 of the rigid support 43 is inserted into the first central hole 410, the annular protrusions 4101 tightly abut against the second embedding portion 433 to enhance tightness between the second inserting portion 433 and the inner surface of the first central hole 410. The center of the top end surface 411 recesses to define a receiving portion 4110. The receiving portion 4110 is substantially cylindrical, and is coaxial to the elastic body 41.

Figure 11:
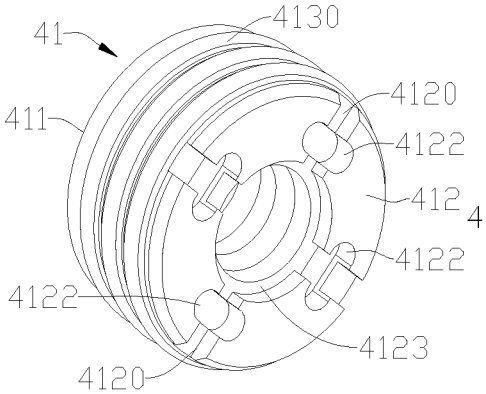
FIG. 11 is a perspective view of the elastic body of the atomizer assembly mounting base in FIG. 9 in another aspect.

Referring also to FIG. 11, the bottom end surface 412 of the elastic body 41 recesses to define a plurality of guiding slots 4120. The guiding slots 4120 surround the first central hole 410 and are arranged radially. Each guiding slot 4120 extends from the sidewall surface 413 to the first central hole 410, whereby enabling air to enter into the first central hole 410.

In some embodiments, the bottom end surface 412 further may recess to define a number of accommodating slots 4122 for accommodating glue, namely, the accommodating slots 4122 functions as glue-dispensing slot. The number of the accommodating slots 4122 is substantially equal to that of the guiding slots 4120. The accommodating slots 4122 correspond to the guiding slots 4120. Each accommodating slot 4122 intersects with the corresponding guiding slot 4120. The axis of the elastic body 41 is equidistant from the accommodating slots 4122. The depth of each accommodating slot 4122 is preferably equal to the depth of the corresponding guiding slot 4120. Each accommodating slot 4122 in some embodiments is substantially waist-shaped, and perpendicularly intersects with the corresponding guiding slot 4120. The number of the accommodating slot 4122 is preferably more than two, to receive cathode and anode wires 531 of the atomizer assembly 50 (see FIG. 17).

Figure 13:
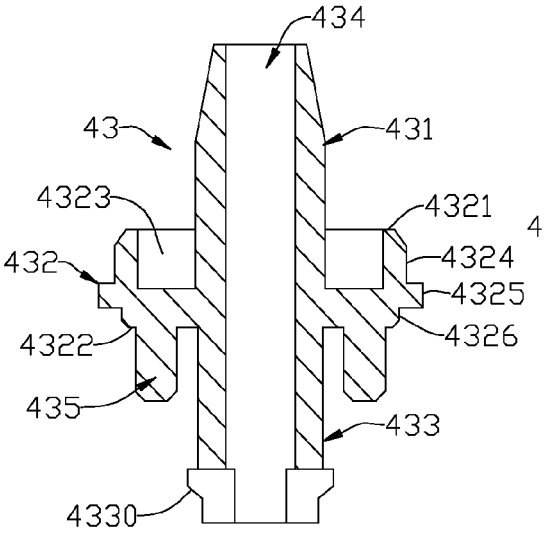
FIG. 13 is an enlarged view of the rigid support of the atomizer assembly mounting base shown in FIG. 4.

Referring to FIG. 11 again, the bottom end surface 412 further recesses to define an annular step 4123. The annular step 4123 surrounds the first central hole 410. The annular step 4123 engages with the second inserting portion 433 of the rigid support 43 (see FIG. 13), to lock the rigid support 43 to the elastic body 41. Preferably, the annular step 4123 is coplanar with the bottom of the guiding slots 4120.

Figure 12:
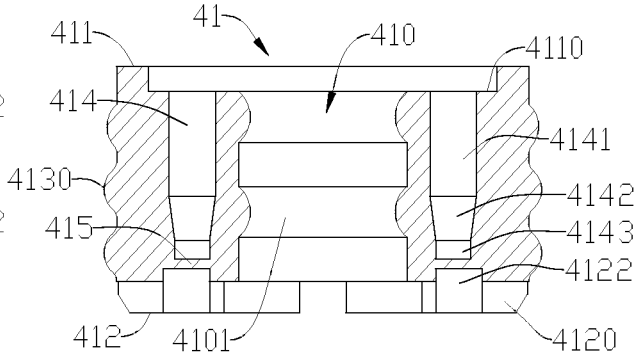
FIG. 12 is an enlarged cross-sectional view of the elastic body of the atomizer assembly mounting base shown in FIG. 3.

Referring also to FIG. 12, the elastic body 41 in some embodiments may further define a number of holes 414. Each hole 414 extends from the top end surface 411 toward the bottom end surface 412, and a stopping wall 415 is formed between the bottom of the hole 414 and the bottom end surface 412. The number of the holes 414 is equal to the number of the accommodating slots 4122, and there is a one-to-one relationship between the holes 414 and the accommodating slots 4122. Each hole 414 extends from the top end surface 411 in a direction adjacent to the corresponding accommodating slot 4122. Preferably, each hole 414 is a blind hole, and extends from the bottom of the receiving portion 4110 in a direction toward the bottom of the corresponding accommodating slot 4122, a stopping wall 415 is formed between the bottom of the hole 414 and the bottom of the corresponding accommodating slot 4122.

Figure 17:
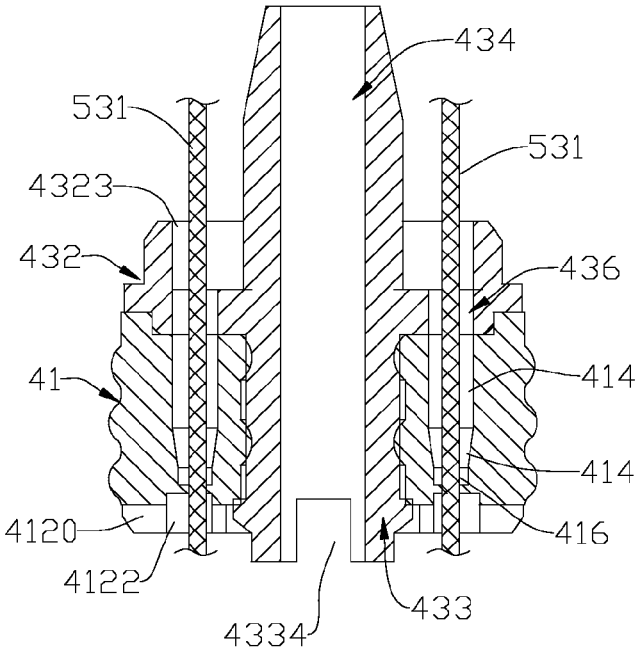
FIG. 17 is an enlarged cross-sectional view of the atomizer assembly mounting base shown in FIG. 3.

Referring to FIG. 17, wires 531 of the atomizer assembly 50 can pierce through the stopping wall 415, and are further electrically connected to the power supply assembly 70. The wires 531 pierce the stopping wall 415 to form piercing hole 416. The accommodating slot 4122 corresponding to the stopping wall 415 which pierced by the wires 531 is dispensed with glue, to secure the wires 531. Because the elastic body 41 is made of elastic material, such as silica gel, when the wires 531 pierce through the stopping wall 415, the pierced hole 416 is small and deformable. When the wires 531 are received in the piercing hole 416, the wires 531 are tightly fastened by the sidewall of the piercing hole 416, to achieve sealing effect. Furthermore, the stopping wall 415 prevents the glue from flowing into the hole 414, thus, the wires 531 can be secured with less glue, and the liquid solution is also protected from being polluted by the glue.

In some embodiments, the number of the holes 414 is preferably two or more than two, to at least allow the cathode and anode wires 531 of the atomizer assembly 50 to pierce respectively. When the rigid support 43 has positioning posts 435, the number of the hole 414 increases correspondingly. For example, the number of the holes 414 illustrated in the FIGS is four, at this time, because some of the holes 414 are used for allowing the wires 531 piercing through the stopping wall 415, and the other holes 414 are used for allow the positioning posts 435 to be inserted thereinto, the uniformly spaced configuration of the holes 414 being arranged surrounding the first central hole 410 is particularly important, such that any holes 414 can be used for allowing the wires 531 and the positioning posts 435 to be inserted thereinto. In other words, it is not need to assign the holes 414 to be used for allowing the wires 531 and the positioning posts 435 in advance, thereby enabling the electronic cigarette 1 being assembled conveniently.

Referring to FIGS. 12 and 17, each hole 414 is preferably cylindrical, and includes a first portion 4141, a second portion 4143, and a connecting portion 4142 for communicating the first portion 4141 with the second portion 4143. The diameter of the first portion 4141 is greater than that of the second portion 4143. The stopping wall 415 is arranged between the second portion 4143 and the corresponding accommodating slot 4122. The diameter of the first portion 4141 is not greater than the diameter of the positioning post 435 of the rigid support 43. The depth of the first portion 4141 is not less than the length of a portion of the positioning post 435 which being inserted into the hole 414. The diameter of the second portion 4143 is less than that of the first portion 4141, to reduce the size of the stopping wall 415, and thus the elasticity of the stopping wall 415 is enhanced. As a result, when the wires 531 pierce through the stopping wall 415, a greater elastic force is generated by the stopping wall 415 to fasten the wires 531 tightly, to achieve a better sealing effect. Preferably, the cross section of the connecting portion 4142 is substantially frustum, to guide the wires 531 to pierce through the stopping wall 415.

Referring to FIGS. 10-12 again, in some embodiments, a plurality of annular flange 4130 protrudes radially and outwardly from the sidewall 413 of the elastic body 41. Each annular flange 4130 extends along the contour of the sidewall 413. Two adjacent annular flanges 4130 are spaced apart from each other, thereby the sidewall 413 is substantially wavy. The maximum outer diameter of the annular flange 4130 is greater than the inner diameter of the housing 10, such that the annular flange 4130 tightly engages with the housing 10 when the elastic body 41 plugs into the housing 10, thereby achieving a good sealing effect, to prevent the liquid solution from flowing from the top end of the elastic body 41 to the bottom end of the elastic body 41 along the sidewall 413.

Referring to FIG. 10 and FIGS. 13-15, the rigid support 43 in some embodiments may be integrally formed from rigid plastic by injection molding. The rigid support 43 may include a first inserting portion 431, a main portion 432, a second inserting portion 433, and a pair of positioning posts 435. The first inserting portion 431 is inserted into the atomizer assembly 50, and the second inserting portion 433 is inserted into the first central hole 410 from the top end surface 411 of the elastic body 41. The rigid support 43 further defines a second central hole 434. The second central hole 434 is used to guide air below the atomizer assembly mounting base 40 to enter into the atomizer assembly 50. The positioning posts 435 are inserted into the holes 414, to prevent the rigid support 43 from rotating circumferentially relative to the elastic body 41.

The first inserting portion 431 and the second inserting portion 433 are coupled to two opposite ends of the main portion 432 respectively. The second central hole 434 extends through the first inserting portion 431, the main portion 432 and the second inserting portion 433 in sequence. The positioning posts 435 protrudes from the main portion 432. The positioning posts 435 and the second inserting portion 433 are arranged at the same end of the main portion 432, and the positioning posts 435 are respectively arranged at two opposite sides of the second inserting portion 433.

Referring to FIGS. 10 and 13 again, the main portion 432 in some embodiments may include a first end surface 4321, a second end surface 4322 opposite to the first end surface 4321. The center of the first end surface 4321 recesses to define an accommodating portion 4323. The first inserting portion 431 protrudes from the bottom of the accommodating portion 4323. The second inserting portion 433 protrudes from the centre of the second end surface 4322. The accommodating portion 4323 in some embodiments may be substantially cylindrical, and be coaxial with the second central hole 434. The accommodating portion 4323 may be used to receive the reservoir 60. The positioning posts 435 are coupled to the second end surface 4322.

Figure 14:
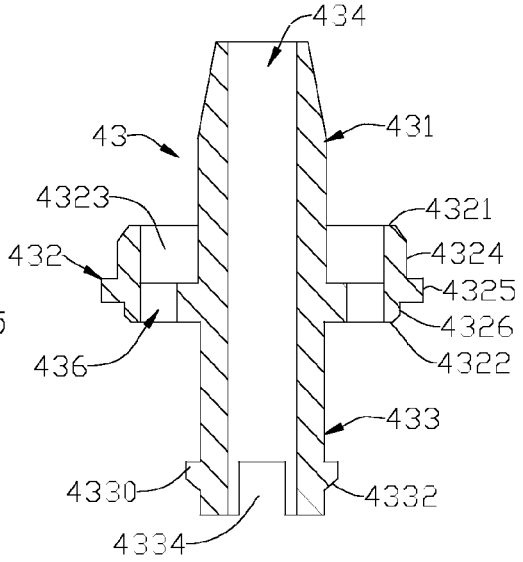
FIG. 14 is an enlarged view of the rigid support of the atomizer assembly mounting base shown in FIG. 3.
Figure 15:
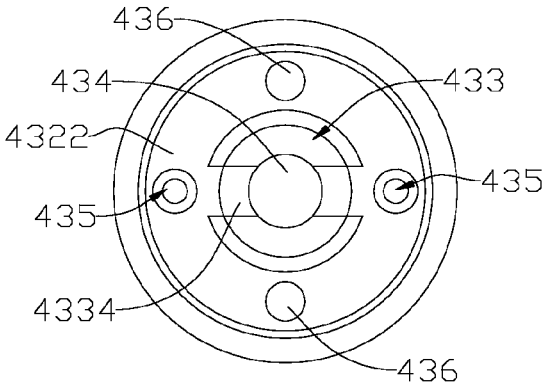
FIG. 15 is a bottom view of the rigid support of the atomizer assembly mounting base shown in FIG. 10.

Referring to FIGS. 14 and 15, in some embodiments, the main portion 432 of the rigid support 43 may further include a pair of receiving holes 436. The receiving holes 436 are arranged at two opposite sides of the second inserting portion 433, to allow cathode and anode wires 531 of the atomizer assembly 50 (see FIG. 17) to pass through respectively. The pair of the receiving holes 436 and the pair of positioning posts 435 are evenly spaced apart and surround the second central hole 434, and the second central hole 434 are equidistant from the receiving holes 436 and the positioning posts 435 (see FIG. 15). The receiving holes 436 and the positioning posts 435 correspond to the holes 414 respectively.

Referring to FIGS. 13 and 14 again, the main portion 432 in some embodiments may be substantially step-cylindrical, and include a first section 4324, a second section 4325, and a third section 4326. The first section 4324, the second section 4325 and the third section 4326 are arranged coaxially between the first end surface 4321 and the second end surface 4322. The first section 4324 and the third section 4326 are arranged at two opposite ends of the second section 4325. The diameter of the second section is substantially equal to the inner diameter of the housing 10. The diameter of the second section 4325 is greater than the diameter of the first section 4324, to form an annular step 4327 (see FIG. 10). When the atomizer assembly mounting base 40 is being installed into the housing 10, the annular step 4327 is adapted to be abutted against by an end surface of a tubular tool 2, so as to facilitate the installation of the atomizer assembly mounting base 40.

Figure 29:
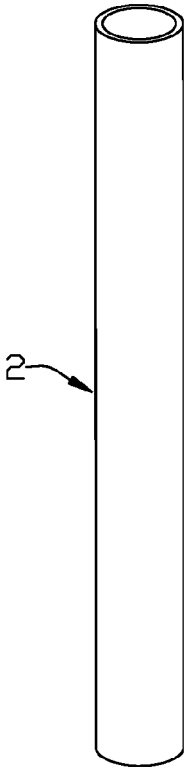
FIG. 29 is a perspective view of a tubular tool in some embodiments.

In detail, the tubular tool 2 illustrated in FIG. 29 is provided. The diameter of the tubular tool 2 is greater than the diameter of the first section 4324, but is slightly less than the inner diameter of the housing 10. When the atomizer assembly mounting base 40 is to be installed into the housing 10, the tubular tool 2 is firstly inserted into the first section 4324, then, the atomizer assembly mounting base 40 is aligned with the housing 10, and is further inserted into the housing 10 by the tubular tool 2. At this time, because the tubular tool 2 abuts against the annular step 4327, a pressure is evenly exerted on the atomizer assembly mounting base 40 by the tubular tool 2, to prevent the atomizer assembly mounting base 40 from slanting or being stuck, so as to ensure the atomizer assembly mounting base 40 being installed accurately.

The diameter of the third section 4326 of the main portion 432 is less than that of the second section 4325, and is substantially equal to the diameter of the receiving portion 4110 of the elastic body 41. The length of the third section 4326 in axis direction is substantially equal to the depth of the receiving portion 4110, to enable the third section 4326 to be fitly inserted into the receiving portion 4110 (see FIG. 16). When the third section 4326 has been inserted into the receiving portion 4110, the second section 4325 tightly abuts against the top end surface 411 of the elastic body 41.

Referring to FIGS. 13 and 15 again, a hook-shaped limiting member 4330 is disposed adjacent to the distal end of the second inserting portion 433. The limiting member 4330 is arranged along the contour of the second inserting portion 433. The diameter of the limiting member 4330 is greater than the diameter of the first central hole 410 of the elastic body 41.

Figure 16:
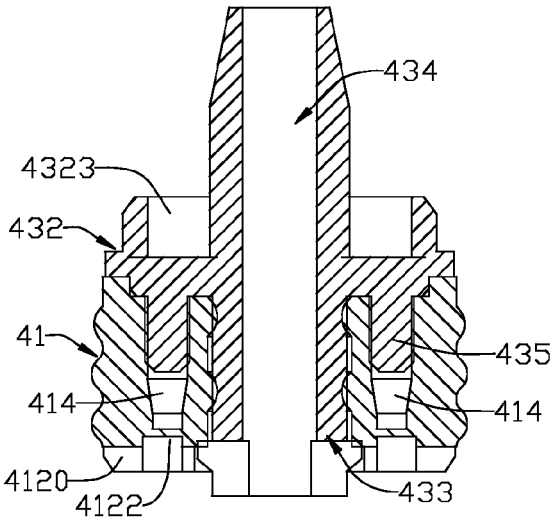
FIG. 16 is an enlarged cross-sectional view of the atomizer assembly mounting base shown in FIG. 4.

Referring to FIG. 16, the distance between the limiting member 4330 and the bottom end surface 4322 of the main portion 432 is substantially equal to the distance between the bottom of the receiving portion 4110 and the annular step 4327, such that when the second inserting portion 433 is inserted into the first central hole 410, the limiting member 4330 tightly hooks the annular step 4327, to prevent the second inserting portion 433 from loosing or detaching from the first central hole 410.

Referring also to FIG. 14, the front end of the limiting portion 4330 in some embodiments may further include a guiding portion 4332. The guiding portion 4332 is substantially tapered, for guiding the limiting portion 4330 to pass through the first central hole 410. Referring also to FIG. 3, the length of the limiting portion 4330 is substantially equal to distance between the bottom end surface 412 of the elastic body 41 and the annular step 4327, thus, when the second inserting portion 433 is inserted into the first central hole 410, the distal end of the second inserting portion 433 extends out of the bottom end surface 412 of the elastic body 41. The distal end of the second inserting portion 433 prevents the power supply assembly 70 from abutting against the bottom end surface of the elastic body 41, thereby providing space for allowing wires 531 to pass through, and preventing air duct from being blocked.

Referring also to FIGS. 10, 14 and 15, in some embodiments, the middle of the sidewall of the second inserting portion 433 may recess to define a groove 4334. The groove 4334 extends from the end surface of the second inserting portion 433 to the top end surface of the limiting portion 4330 in a direction parallel to the axis of the second inserting portion 433, and extends laterally and upwardly through the second inserting portion 433 and the limiting portion 4330, to communicate with the guiding slot 4120 of the elastic body 41 (see FIG. 16). Thus, air can flow into the atomizer assembly 50 by passing through the guiding slot 4120, the groove 4334, and the second central hole 434 in sequence.

Referring to FIG. 15, the extending direction of the orthographic projection of the groove 4334 on the second end surface 4322 coincides with a connecting line between the pair of the positioning posts 435. Thus, when the electronic cigarette 1 has been installed (see FIG. 16), the groove 4334 faces the guiding slot 412 with no wires 531, to prevent air from being blocked by the wires 531 and/or solidified glue for fixing the wires 531. Referring to FIG. 17, when the electronic cigarette 1 has been assembled, the guiding slot 4120 which wires 531 pass through is blocked by the second engaging portion 433, thereby preventing the wires 531 and/or glue from being adversely affected by the flowing air. Such as, the continuous blowing of the air flow to the wires 531 either leads to that the electric connecting portions of the wires 531 are damaged, or leads to that the connection between the wires 51 and the glue is loosed, and the fixing effect of the glue is reduced.

Figure 18:
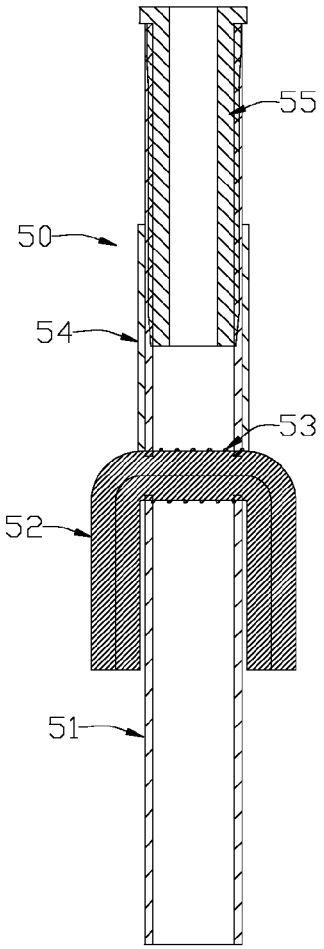
FIG. 18 is an enlarged cross-sectional view of the atomizer assembly shown in FIG. 3.
Figure 19:
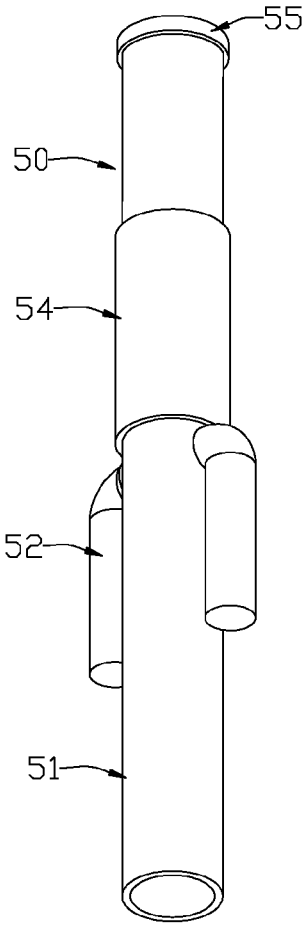
FIG. 19 is a perspective view of the atomizer assembly shown in FIG. 3.

Referring to FIGS. 18 and 19, the atomizer assembly 50 in some embodiments may include an air flowing pipe 51, a wick 52, a heating member 53, a positioning sleeve 54, and a supporting pipe 55. An inlet end of the air flowing pipe 51 is adapted to sleeve the first inserting portion 431 of the rigid support 43 (see FIGS. 3 and 4), an outlet end of the air flowing pipe 51 faces the central through hole 210. The wick 52 is made of fiber glass, and traverses the sidewall of the central through hole 210 with two opposite ends extending out of the air flowing pipe 51, to suck solution in the reservoir 60 into the air flowing pipe 51 by capillarity. The heating member 53 is received in the air flowing pipe 51 and engages with the wick 52. The heating member 53 mainly engages with a portion of the wick 52 disposed in the air flowing pipe 51, so as to atomize the solution sucked in the wick 52 by heating. The positioning sleeve 54 sleeves on the air flowing pipe 51 and is coaxial with the air flowing pipe 51, to reinforce a particular portion of the air flowing pipe 51. The supporting pipe 55 sleeves on the outlet of the air flowing pipe 51 to protect the air flowing pipe 51 from being deformed when pressed, thereby preventing the air flowing pipe 51 from blocking smoke flow therein. The supporting pipe 55 further prevents the reservoir 60 from being excessively deformed when an external force radially exert on the electronic cigarette 1, thus, leakage of a large amount of solution from the reservoir 60 is avoided. Furthermore, the supporting pipe 55 is spaced apart from the ring 23, to prevent solution on the supporting pipe 55 from transferring to the ring 23.

Figure 20:
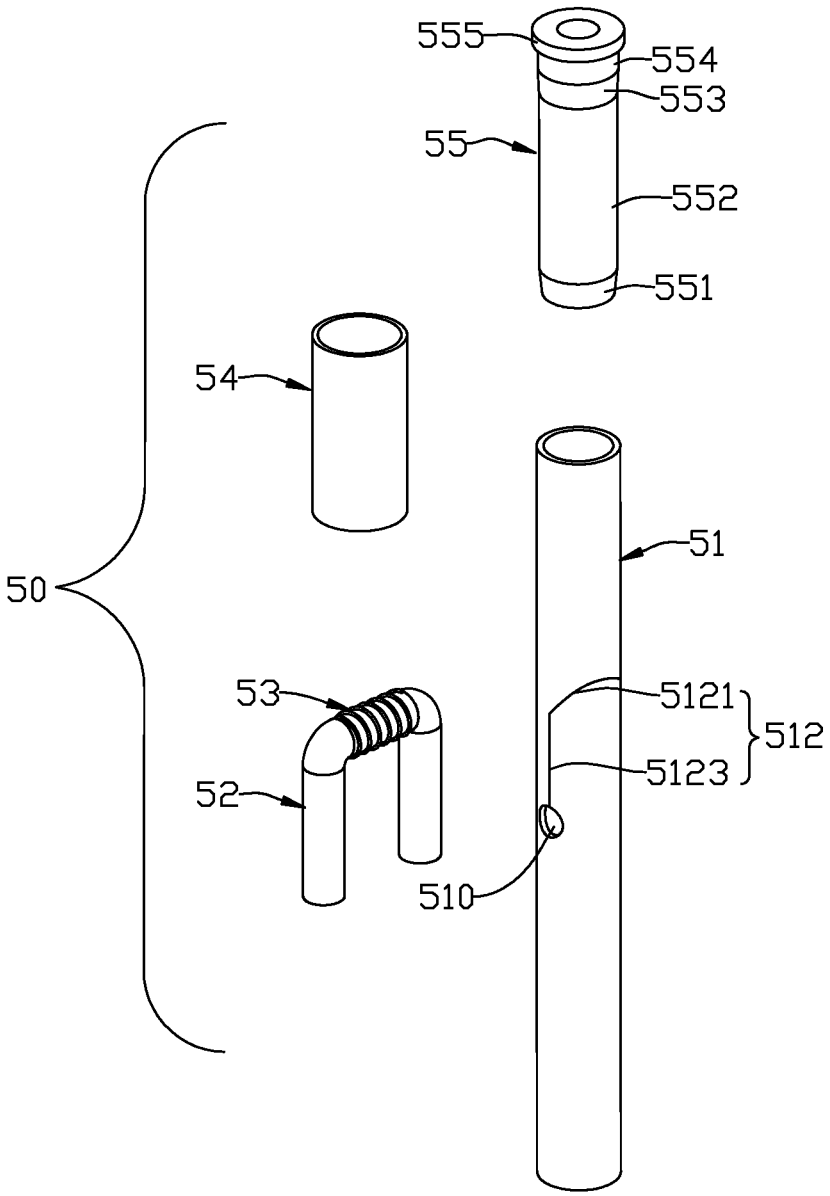
FIG. 20 is an exploded view of the atomizer assembly shown in FIG. 19.

Referring to FIG. 20, the air flowing pipe 51 in some embodiments may be substantially cylindrical slender shaped, and may be weaved of a material, such as fiber. The diameter of the inlet of the air flowing pipe 51 is less than the diameter of the first engaging portion 431 of the rigid support 43, thereby enabling the air flowing pipe 51 being inserted into the first inserting portion 431 by an interference fit. The sidewall of the air flowing pipe 51 defines two opposite through holes 510. The diameter of the through holes 510 is suitable for receiving the wick 52. Two opposite ends of the wick 52 extend out of the air flowing pipe 51. For conveniently installing the wick 52, a cut 512 is defined in the sidewall of the air flowing pipe 51. The cut 512 communicates with the through holes 510, to allow the wick 52 being placed laterally into the through holes 510 via the cut 512, thereby enabling the wick 52 being installed easily. In some embodiments, the cut 512 is arranged above the through holes 510.

Figure 21:
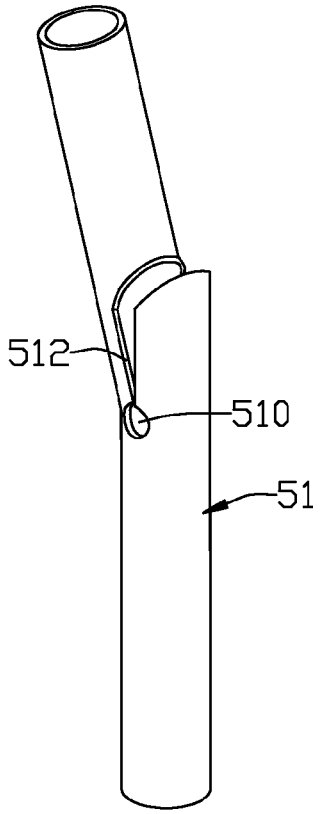
FIG. 21 is a perspective view of the air flowing pipe of the atomizer assembly shown in FIG. 19 when the air flowing pipe is split off along a cut.

Referring to FIG. 21, the cut 512 allows two portions of the air flowing pipe 51 divided by the cut 512 to be split to angle with each other, thus, an open is defined and communicates with the through holes 510. The open allows the wick 52 to be placed laterally into the through holes 510 without aligning and extending through the through holes 510. The wick 52 in some embodiments includes a first section 5121 and a second section 5123 connected to the first section 5121. The first section 5121 extends laterally and outwardly. The second section 5123 extends to and communicates with the through holes 510. Preferably, the angle between the first section 5121 and the second section 5123 is an obtuse angle. It is noteworthy that the angle between the first section 5121 and the second section 5123 can be a right angle.

Because of the cut 512 defined in the air flowing pipe 51, the strength of the air flowing pipe decreases in some certain. When reacted by an external force, such as the pressure from the reservoir 60, the probability of a position of the air flowing pipe 51 corresponding to the cut 512 being collapsed increases, which may result in a problem. To overcome this problem, a positioning sleeve 54 sleeves on the air flowing pipe 54 and corresponds to the cut 512, thus, the external force exerted on the air flowing pipe 51 disperses to other portions of the air flowing pipe 51, to reduce the external force focusing on the position of the air flowing pipe 51 corresponding to the cut 512. The positioning sleeve 54 and the air flowing pipe 51 may be made of the same material. The inner diameter of the positioning sleeve 54 is substantially equal to the outer diameter of the air flowing pipe 51. The length of the positioning sleeve 54 is greater than the maximum length of the cut 512 extending along the longitude of the air flowing pipe 51. As a result, the positioning sleeve 51 is able to tightly sleeve on the air flowing pipe 51 to cover the cut 512, thereby improving the anti external force ability of the air flowing pipe 51.

Referring also to FIG. 21, the heating member 53 in some embodiments may be metal heating wire. The heating member 53 coils around the portion of the wick 52 located in the air flowing pipe 51, to atomize solution sucked in the wick 52 by heating. Referring also to FIGS. 3 and 17, two opposite ends of the heating member 53 are electrically connected to two wires 531 respectively. The wires 531 extend out of the air flowing pipe 51 by passing through the through holes 510, and then extend through the receiving hole 436 of the rigid support 43, the hole 413 of the elastic body 41 in sequence, and further penetrate through the stopping wall 415 to be electrically connected to the power supply assembly 70.

The supporting pipe 55 in some embodiments may be made of rigid plastic. The supporting pipe 55 includes a first section 552, a transmission section 553 connected to the first section 552, a second section 554 connected to an end of the transmission section 553 opposite to the first section 552, and a resisting portion 555 connected to the second section 554. The outer diameter of the first section 552 is slightly greater than the inner diameter of the air flowing pipe 51, to enable the first section 552 being inserted into the air flowing pipe 51 by an interference fit. The outer diameter of the second section 554 is slightly greater than the outer diameter of the first section 552. The cross section of the transmission section 553 is substantially tapered. An end of the transmission section 553 with bigger diameter is connected to the second section 554, the other end of the transmission section 553 is connected to the first section 552, thereby the first section 552 is connected to the second section 554 via the transmission section 553. Because the first section 552 and the second section 554 are interference fit with the air flowing pipe 51 respectively, the supporting pipe 55 are tightly secured to the air flowing pipe 51. The outer diameter of the resisting portion 555 is greater than the outer diameter of the air flowing pipe 51, and the resisting portion 555 abuts against the air flowing pipe 51 when the supporting pipe 55 has been inserted into the air flowing pipe 51.

In some embodiments, the supporting pipe 55 may further include a guiding portion 551. The guiding portion 551 is connected to a side of the first section 552 opposite to the transmission section 553, namely, the guiding portion 551 is arranged at the foremost end of the first section 552. The guiding portion 551 is substantially cone-shaped, and the outer diameter of the distal end thereof is less than the diameter of the air flowing pipe 51, thereby enabling the supporting pipe 55 to be aligned with the central through hole 210 of the air flowing pipe 51.

Figure 22:
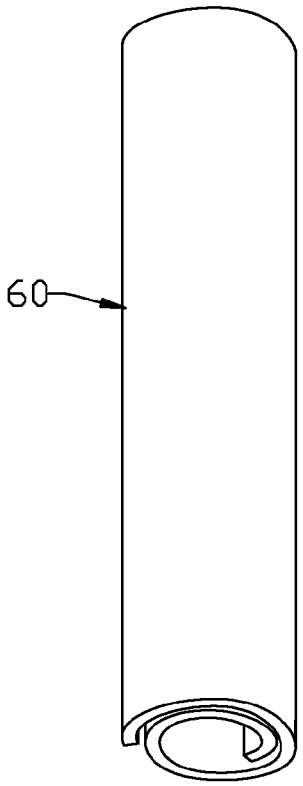
FIG. 22 is a perspective view of the reservoir of the electronic cigarette shown in FIG. 3.

Referring to FIG. 22, the reservoir 60 in some embodiments may be substantially cylindrical, and is formed by rolling cotton sheet. Referring to FIG. 3 again, the reservoir 60 wraps the atomizer assembly 50, and tightly contact the wick 52 of the atomizer assembly 50, thereby solution in the reservoir 60 is able to be transported ceaselessly into the air flowing pipe 51 by virtue of the capillarity of the wick 52. The bottom end of the reservoir 60 is inserted into the accommodating portion 4323, and the top end of the reservoir 60 abuts against the rear end surface of the supporting pipe 55, so as to prevent the reservoir 60 from blocking the central through hole 210 of the air flowing pipe 51.

The power supply assembly 70 in some embodiments may include a cylindrical soft-packing lithium battery. The power supply assembly 70 is housed in the housing 10, and an interval is defined between the power supply assembly 70 and the inner surface of the housing 10, to allow air flowing. The air switch 80 in some embodiments may be substantially flat cylinder. Referring to FIGS. 8 and 23, the air switch 80 is mounted to the step 330 of the end cover 30, and has an interference fit with the inner sidewall of the end cover 30. A chamber is defined between the air switch 80 and the bottom of the end cover 30. The chamber communicates with the surrounding environment via the apertures 313. The light emitting unit 90 in some embodiments may be a light emitting diode (LED), and is mounted to a surface of the air switch 80 facing the bottom wall 31.

The electronic cigarette 1 as described above may be assembled by executing following steps:

A. Providing the atomizer assembly mounting base 40 and the atomizer assembly 50; and sleeving the atomizer assembly 50 on the first inserting portion 431 of the rigid support 43;

B. Letting the wires 531 coupled to the heating member 53 of the atomizer assembly 50 to pass through the receiving hole 436, the hole 414 in sequence, and further pierces through the stopping wall 415 located at the bottom of the hole 414;

C. Dispersing liquid glue into the accommodating slot 4122 corresponding to the stopping wall 415 where the wires 531 penetrate through, to seal the piercing hole 416;

D. Providing the reservoir 60 and wrapping the reservoir 60 tightly around the peripheral of the atomizer assembly 50;

E. Providing the housing 10, and inserting an assembly of the atomizer assembly mounting base 40, the atomizer assembly 50 and the reservoir 60 into the interior of the cylindrical housing 10 from one end of the housing 10 to a predetermined position by the tubular tool 2; wherein, the annular flange 4130 of the sidewall of the elastic body 41 of the atomizer assembly mounting base 40 tightly abuts against the inner surface of the housing 10, to enhance the sealing effect between the atomizer assembly mounting base 40 and the housing 10;

F. Providing the mouthpiece 20; and coupling the mouthpiece 20 to the one end of the housing 10;

G. Providing the power supply assembly 70, and inserting the power supply assembly 70 into the housing 10 via the other end of the housing 10 opposite to the one end;

H. Letting the power supply assembly 70 being electrically connected to the wires 531 of the atomizer assembly 50;

I. Providing the end cover 30, the air switch 80, and the light emitting unit 90; inserting the air switch 80 into the end cover 30, and mounting the light emitting unit 90 to a surface of the air switch 80 facing the bottom wall 31 of the cover 30;

J. Letting the air switch 80 and the light emitting unit 90 being electrically connected to the power supply assembly 70;

K. Inserting the assembly of the end cover 70, the air switch 80 and the light emitting unit 90 into the other end of the housing 10, and the assembling of the electronic cigarette 1 is finished.

Wherein, before the step A is executed, further include steps for assembling the atomizer assembly mounting base 40. The assembling of the atomizer assembly mounting base 40 includes following steps:

S1. Providing the rigid support 43 and the elastic body 41;

S2. Inserting the second inserting portion 433 of the rigid support 43 into the first central hole 410 of the elastic body 41 from the top end surface 411 of the elastic body 41;

In step S2, before the second inserting portion 433 is inserted into the first central hole 410, the receiving holes 436 defined in the second inserting portion 433 are aligned with the holes 414, for allowing the wires 531 to extend through in sequence. The annular protrusions 4101 on the inner wall of the first central hole 410 of the elastic body 41 tightly abuts against the sidewall of the second inserting portion 433, to enhance the sealing effect between the second inserting portion 433 and the elastic body 41.

S3. Letting the main portion 432 of the elastic body 41 abutting against the top end surface 411 of the elastic body 41;

In step S3, the third section 4326 of the main portion 432 of the rigid support 43 is inserted into the receiving portion 4110 of the top end surface 411 of the elastic body 41, and the second section 4325 abuts tightly against the top end surface 411 of the elastic boy 41. Furthermore, the limiting portion 4330 adjacent to the distal end of the second extending portion 433 of the rigid support 43 hooks the annular step 4327 of the bottom end surface of the elastic body 41, to lock the elastic body 41 to the rigid support 43.

Hereinafter, combined with the work principle of the electronic cigarette 1 to illustrate the present invention:

When a "sucking" action takes place at the mouthpiece 20, a negative pressure is formed in the inner space of the housing 10, namely, a variation air pressure is formed. When the air switch 80 detects the variation air pressure, the air switch 80 is actuated to conduct the power supply assembly 70 and the heating member 53 of the atomizer assembly 50, and the heating member 53 is heating to atomize the solution sucked in the wick 52 disposed within the air flowing pipe 51 to form smoke. At the same time, the air switch 80 also conducts the light emitting unit 90 and the power supply assembly 70 when the air switch 80 detects the variation air pressure, to simulate firework effect of burning cigarette.

Furthermore, at the time of the negative air pressure is formed, external air (hereinafter, first air) firstly enter into the housing 10 by passing through the inlet 314 of the end cover 30 and the guiding groove 335 in sequence. The first air further flows into the second central hole 434 of the rigid support 43 along the clearance between the power supply assembly 70 and the inner wall of the housing 10, and then enter into the air flowing pipe 51 of the atomizer assembly 50 via the second central hole 434. Finally, the first air together with the smoke atomized by the atomizer assembly 50 flow out of the housing 10 by passing through the supporting pipe 55 and the mouthpiece 20, to simulate sucking cigarette.

At the time of the negative air pressure is formed, another air (hereinafter, second air) enter into the electronic cigarette 1 by passing through the aperture 313 and the inner guiding groove 336 in sequence. The flowing procedure of the second air is the same to the first air, and not repeat to illustrate the flowing procedure of the second air here.

Figure 24:
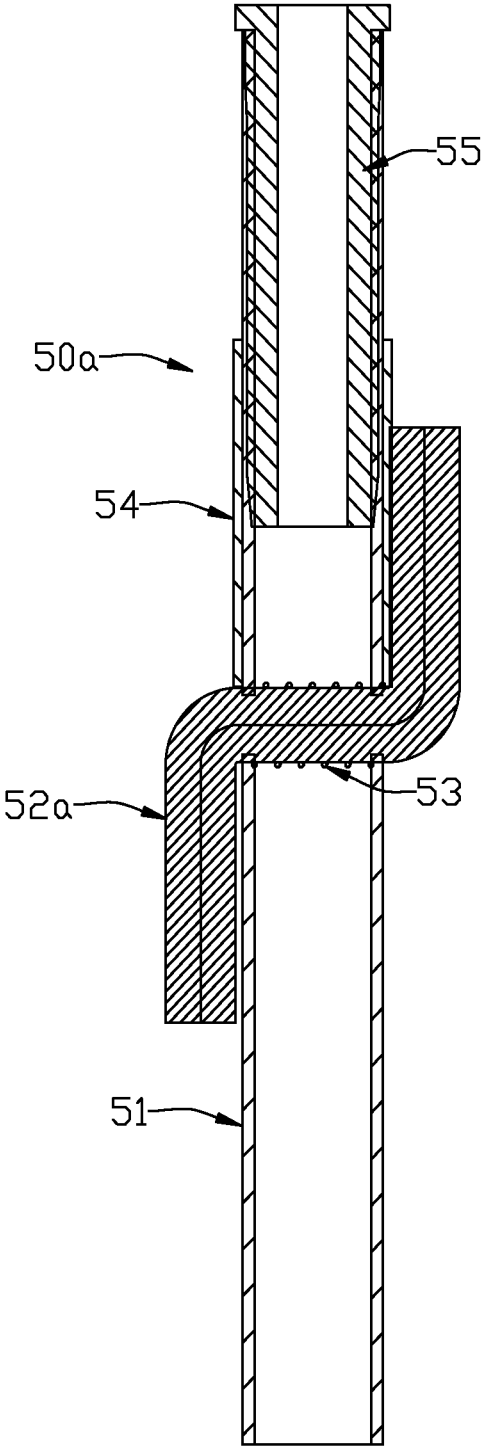
FIG. 24 is a perspective view of another atomizer assembly in some embodiments of the present invention.

FIG. 24 illustrates an atomizer assembly 50*a* in a second embodiment. The atomizer assembly 50*a* includes the air flowing pipe 51, a wick 52*a*, the heating member 53, the positioning sleeve 54, and the supporting pipe 55. An inlet end of the air flowing pipe 51 sleeves the first inserting portion 431 of the rigid support 43 (see FIGS. 3 and 4), and communicates with the second central hole 434 of the rigid support 43. The wick 52*a* traverses the sidewall of the air flowing pipe 51 with two opposite ends extending out of the air flowing pipe 51. The ends of the wick 52*a* extending out of the air flowing pipe 51 are coupled to the reservoir 60, to suck solution in the reservoir 60 into the air flowing pipe 51. One ends of the wick 52*a* extending out of the air flowing pipe 51 extends downward, and the other end of the wick 52*a* extending out of the air flowing pipe 51 extends upwardly. In relative to the configuration of the wick 52 with both ends thereof extending downward illustrated in FIG. 18, the configuration of the wick 52*a* enables solution in the top of the reservoir 60 and solution in the bottom of the reservoir 60 to be evenly guided into the air flowing pipe 51. The heating member 53 engages with a portion of the wick 52*a* disposed within the air flowing pipe 51, and atomizes the solution sucked into the portion of the wick 52*a* by heating. The positioning sleeve 54 sleeves on the air flowing pipe 51 and is coaxial with the air flowing pipe 51, to reinforce a particular portion of the air flowing pipe 51. The supporting pipe 55 sleeves on the outlet of the air flowing pipe 51 to protect the air flowing pipe 51 from being deformed when pressed, thereby preventing the air flowing pipe 51 from blocking smoke flowing therein. The supporting pipe 55 further prevents the reservoir 60 from being excessively deformed when an external force radially exert on the electronic cigarette 1, thus, leakage of solution from the reservoir 60 is avoided.

Figure 25:
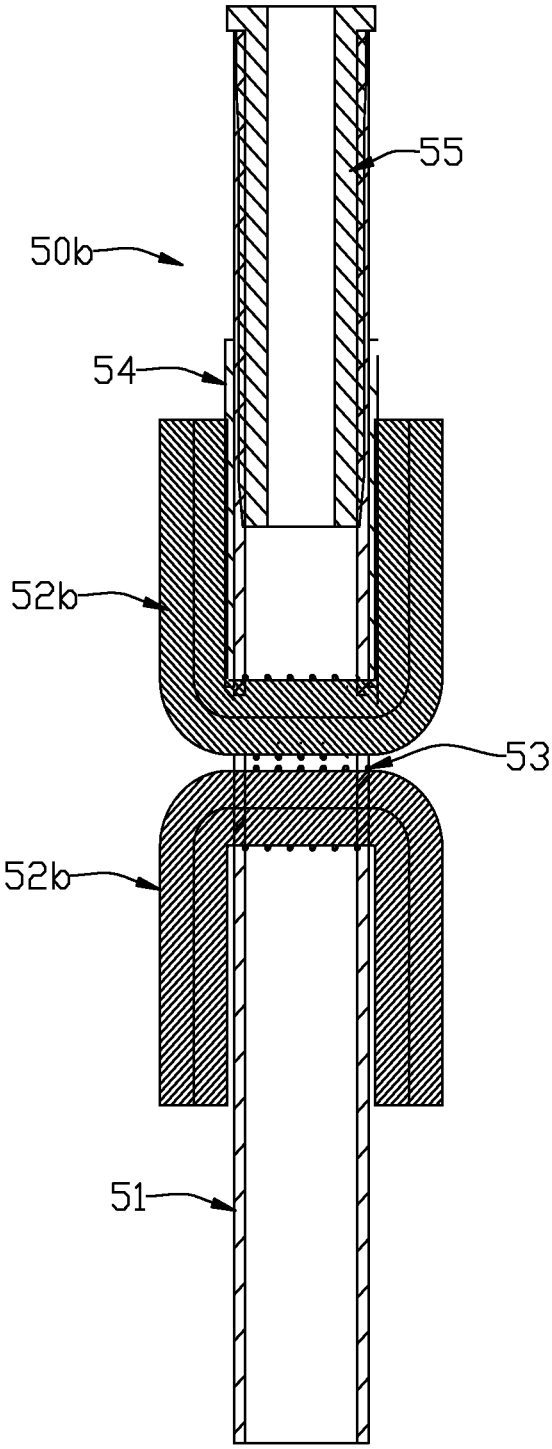
FIG. 25 is a perspective view of further another atomizer assembly in some embodiments of the present invention.

FIG. 25 illustrates an atomizer assembly 50*b* in a second embodiment. The atomizer assembly 50*b* includes the air flowing pipe 51, two wicks 52*b*, the heating member 53, the positioning sleeve 54, and the supporting pipe 55. An inlet end of the air flowing pipe 51 sleeves the first inserting portion 431 of the rigid support 43 (see FIGS. 3 and 4), and communicates with the second central hole 434 of the rigid support 43. The wicks 52*b* traverse the sidewall of the air flowing pipe 51 with two opposite ends extending out of the air flowing pipe 51. The ends of each wick 52*b* extending out of the air flowing pipe 51 are coupled to the reservoir 60, to suck solution in the reservoir 60 into the air flowing pipe 51. Two opposite ends of one wick 52*b* extending out of the air flowing pipe 51 extends downward, and two opposite ends of the other wick 52*b* extending out of the air flowing pipe 51 extends upwardly. In relative to the configuration of the wick 52*a* illustrated in FIG. 24, the configuration of the wick 52*b* enhances the capability of sucking solution, and also enables solution in the top of the reservoir 60 and solution in the bottom of the reservoir 60 to be evenly guided to the air flowing pipe 51. The heating member 53 engages with a portion of the wick 52*b* disposed within the air flowing pipe 51, and atomizes the solution sucked in the portion of the wick 52*b* by heating. The positioning sleeve 54 sleeves on the air flowing pipe 51 and is coaxial with the air flowing pipe 51, to reinforce a particular portion of the air flowing pipe 51. The supporting pipe 55 sleeves on the outlet of the air flowing pipe 51 to protect the air flowing pipe 51 from being deformed when pressed, thereby preventing the air flowing pipe 51 from blocking smoke flowing therein. The supporting pipe 55 further prevents the reservoir 60 from being excessively deformed when an external force radially exert on the electronic cigarette 1, thus, leakage of solution from the reservoir 60 is avoided. Furthermore, only one of the wicks 52*b* is arranged with the heating member.

Figure 26:
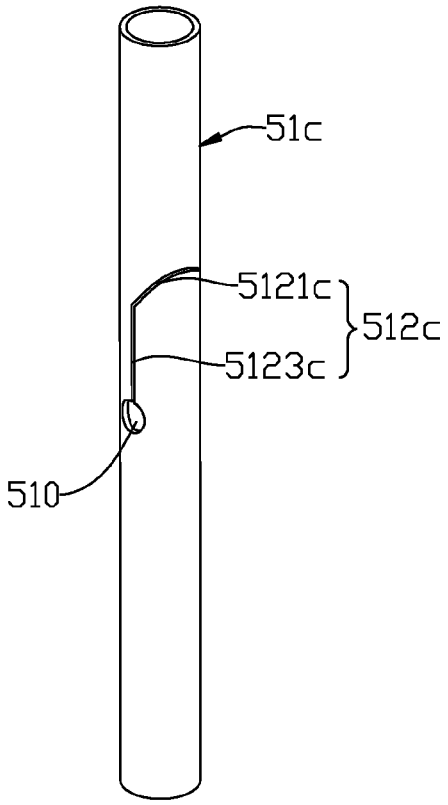
FIG. 26 is a perspective view of another air flowing pipe in some embodiments of the present invention.

FIG. 26 illustrates an air flowing pipe 51*c* in some embodiments. For conveniently installing the wick 52, a cut 512*c* is defined in the sidewall of the air flowing pipe 51*c*. The cut 512*c* is arranged above and communicates with the through holes 510. The cut 512*c* allows two portions of the air flowing pipe 51*c* divided by the cut 512*c* to be split to angle with each other, whereby the wick 52 can be placed laterally into the through holes 510 conveniently via the cut 512*c* without aligning and extending through the through holes 510. The wick 52*c* in some embodiments includes a first section 5121*c* and a second section 5123*c* connected to the first section 5121*c*. The first section 5121*c* extends laterally and outwardly. The second section 5123*c* extends to and communicates with the through holes 510.

Figure 27:
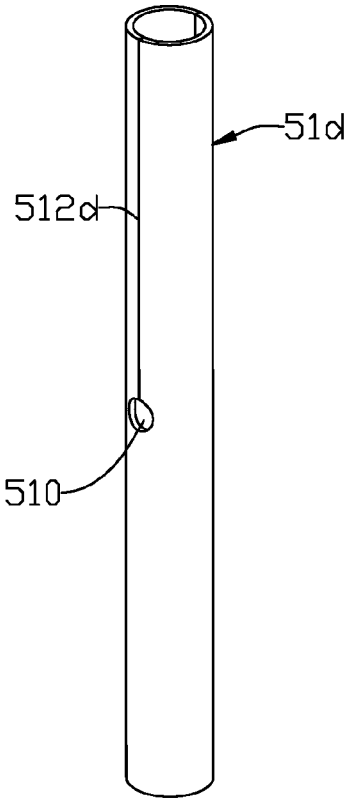
FIG. 27 is a perspective view of further another air flowing pipe in some embodiments of the present invention.

FIG. 27 illustrates an air flowing pipe 51*d* in some embodiments. For conveniently installing the wick 52, a cut 512*d* is defined in the sidewall of the air flowing pipe 51*d*. The cut 512*d* is arranged above the through holes 510. The cut 512*d* extends from the top end surface of the air flowing pipe 51*d* to the through holes 510. The cut 512*d* allows two portions of the air flowing pipe 51*d* divided by the cut 512*d* to be split to angle with each other, whereby the wick 52 can be placed laterally into the through holes 510 conveniently via the cut 512*d* without aligning and extending through the through holes 510.

Figure 28:
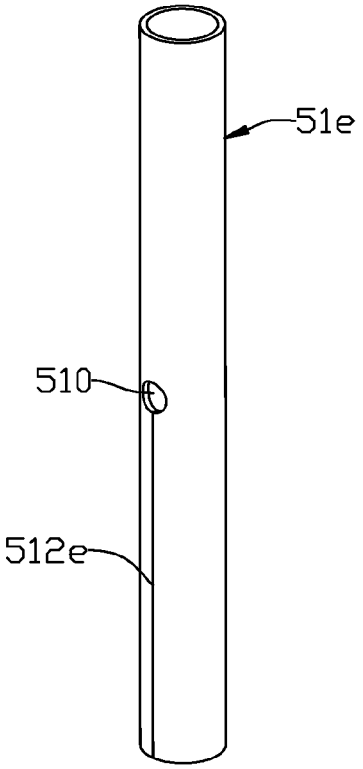
FIG. 28 is a perspective view of still another air flowing pipe in some embodiments of the present invention.

FIG. 28 illustrates an air flowing pipe 51*e* in some embodiments. For conveniently installing the wick 52, a cut 512*e* is defined in the sidewall of the air flowing pipe 51*e*. The cut 512*e* is arranged below the through holes 510. The cut 512*e* extends from the bottom end surface of the air flowing pipe 51*e* to the through holes 510. The cut 512*e* allows two portions of the air flowing pipe 51*e* divided by the cut 512*e* to be split to angle with each other, whereby the wick 52 can be placed laterally into the through holes 510 conveniently via the cut 512*e* without aligning and extending through the through holes 510.

It should be pointed out that, for an ordinary person skilled in the art, many modifications and variations could be made without departing from the scope and spirit of the claims as appended. For the scope of the present invention, the disclosure of the present invention is illustrative but not restrictive, and the scope of the present invention is defined by the appended claims.

What is claimed is:

1. An atomizer assembly mounting base, used for an electronic cigarette having an atomizer assembly and a cylindrical housing for receiving the atomizer assembly mounting base and the atomizer assembly, the atomizer assembly mounting base comprising: an elastic body for engaging with an inner sidewall of the housing of the electronic cigarette; and a rigid support for supporting the atomizer assembly of the electronic cigarette; wherein the elastic body defines a first central hole, and the rigid support is inserted into the first central hole; the elastic body comprises a top end surface, a bottom end surface opposite to the top end surface, and a sidewall surface connecting the top end surface with the bottom end surface, the first central hole extends from the top end surface to the bottom end surface; and wherein the rigid support comprises a first inserting portion, a main portion, a second inserting portion, and a second central hole; the first inserting portion and the second inserting portion are coupled to a top side and a bottom side of the main portion respectively, and are inserted into the atomizer assembly and the elastic body respectively; the second central hole extends through the first inserting portion, the main portion, and the second inserting portion in sequence; the second inserting portion is inserted into the first central hole from the top end surface.

2. The atomizer assembly mounting base as described in claim 1, wherein a plurality of annular flange protrudes radially and outwardly from the sidewall of the elastic body, each annular flange extends along the contour of the sidewall, two adjacent annular flanges are spaced apart from each other, the maximum outer diameter of the annular flange is greater than the inner diameter of the housing; and/or the inner surface of the first central hole is provided with at least two annular protrusions, the annular protrusions are spaced apart, the annular protrusions tightly abut against the sidewall of the second embedding portion.

3. The atomizer assembly mounting base as described in claim 1, wherein the bottom end surface of the elastic body recesses to define a plurality of guiding slots, the guiding slots surround the first central hole and are arranged radially, each guiding slot extends from the sidewall surface of the elastic body to the first central hole.

4. The atomizer assembly mounting base as described in claim 3, wherein the bottom end surface recesses to define an annular step surrounding the first central hole, the annular step is coplanar with the bottom of the guiding slots; and a hook-shaped limiting member is arranged adjacent to the distal end of the second inserting portion, the limiting member is arranged along the contour of the second inserting portion, the diameter of the limiting member is greater than the diameter of the first central hole of the elastic body, the limiting portion hooks the annular step of the bottom end surface of the elastic body.

5. The atomizer assembly mounting base as described in claim 4, wherein the middle of the sidewall of the second inserting portion recesses to define a groove, the groove extends from the end surface of the second inserting portion to the top end surface of the limiting portion in a direction parallel to the axis of the second inserting portion, and extends laterally and upwardly through the second inserting portion and the limiting portion.

6. The atomizer assembly mounting base as described in claim 4, wherein the front end of the limiting portion comprises a tapered guiding portion, for guiding the limiting portion to pass through the first central hole.

7. The atomizer assembly mounting base as described in claim 3, wherein the bottom end surface further recesses to define a number of accommodating slots for accommodating glue, the accommodating slots correspond to the guiding slots, each accommodating slot intersects with the corresponding guiding slot, the depth of each accommodating slot is greater the depth of the corresponding guiding slot.

8. The atomizer assembly mounting base as described in claim 7, wherein the elastic body further defines a number of holes, the number of the holes is equal to the number of the accommodating slots, and the holes correspond to the accommodating slots respectively; the hole is a blind hole, and extends from the bottom of the receiving portion in a direction toward the bottom of the corresponding accommodating slot, a stopping wall is formed between the bottom of the hole and the bottom of the corresponding accommodating slot.

9. The atomizer assembly mounting base as described in claim 8, wherein each hole is cylindrical, and comprises a first portion, a second portion, and a connecting portion for communicating the first portion with the second portion, the diameter of the first portion is greater than that of the second portion, the stopping wall is arranged between the second portion and the corresponding accommodating slot.

10. The atomizer assembly mounting base as described in claim 1, wherein the main portion comprises a first end surface, a second end surface opposite to the first end surface, the center of the first end surface recesses to define an accommodating portion, the first inserting portion protrudes from the bottom of the accommodating portion, the second inserting portion protrudes from the centre of the second end surface.

11. The atomizer assembly mounting base as described in claim 10, wherein the main body comprises a first section, a second section, and a third section, the first section, the second section and the third section are arranged coaxially between the first end surface and the second end surface, an annular step is formed between the first section and the second section; the center of the top end surface of the soft body recesses to define an accommodating portion, the third section is inserted into the accommodating portion, the second section tightly abuts against the top end surface.

12. The atomizer assembly mounting base as described in claim 10, wherein the rigid support comprises two positioning posts, the positioning posts are connected to the circumference of the second end surface surrounding the second central hole, the positioning posts are respectively arranged at opposite sides of the second inserting portion; and/or the rigid support defines two receiving holes, the receiving holes are arranged at opposite sides of the second inserting portion, the receiving holes are arranged on the circumference of the second end surface surrounding the second central hole and are evenly spaced apart from each other.

13. An electronic cigarette, comprising: a cylindrical housing, a mouthpiece, an end cover, a reservoir, a power supply assembly, an atomizer assembly, and an atomizer assembly mounting base; wherein the atomizer assembly mounting base comprises an elastic body engaging with an inner sidewall of the housing of the electronic cigarette, and a rigid support for supporting the atomizer assembly of the electronic cigarette; the elastic body defines a first central hole, and the rigid support is inserted into the first central hole; wherein the mouthpiece and the end cover respectively cover two opposite ends of the housing; the atomizer assembly mounting base, the atomizer assembly, the reservoir, and the power supply assembly are housed in the housing; the atomizer assembly mounting base is arranged in the middle of the housing; the atomizer assembly is mounted to the atomizer assembly mounting base and is arranged between the mouthpiece and the atomizer assembly mounting base; the reservoir is disposed at the peripheral of the atomizer assembly; the power supply assembly is arranged between the atomizer assembly mounting base and the end cover and is electrically connected to the atomizer assembly; the elastic body comprises a top end surface, a bottom end surface opposite to the top end surface, and a sidewall surface connecting the top end surface with the bottom end surface, the first central hole extends from the top end surface to the bottom end surface; and wherein the rigid support comprises a first inserting portion, a main portion, a second inserting portion, and a second central hole; the first inserting portion and the second inserting portion are coupled to a top side and a bottom side of the main portion respectively, and are inserted into the atomizer assembly and the elastic body respectively; the second central hole extends through the first inserting portion, the main portion, and the second inserting portion in sequence; the second inserting portion is inserted into the first central hole from the top end surface.

14. The electronic cigarette as described in claim 13, wherein the atomizer assembly comprises an air flowing pipe, a wick, a heating member, and a positioning sleeve; the inlet of the air flowing pipe sleeves on the rigid support of the atomizer assembly mounting base, the outlet of the air flowing pipe faces a central through hole of the mouthpiece, the sidewall of the air flowing pipe defines two opposite holes and a cut communicating with the holes; the wick extends through the holes, the positioning sleeve sleeves a portion of the air flowing pipe corresponding to the cut.

15. The electronic cigarette as described in claim 13, wherein a plurality of annular flange protrudes radially and outwardly from the sidewall of the elastic body, each annular flange extends along the contour of the sidewall, two adjacent annular flanges are spaced apart from each other, the maximum outer diameter of the annular flange is greater than the inner diameter of the housing; and/or the inner surface of the first central hole is provided with at least two annular protrusions, the annular protrusions are spaced apart, the annular protrusions tightly abut against the sidewall of the second embedding portion.

16. The electronic cigarette as described in claim 14, wherein the bottom end surface of the elastic body recesses to define a plurality of guiding slots, the guiding slots surround the first central hole and are arranged radially, each guiding slot extends from the sidewall surface of the elastic body to the first central hole.

17. The electronic cigarette as described in claim 16, wherein the bottom end surface recesses to define an annular step surrounding the first central hole, the annular step is coplanar with the bottom of the guiding slots; and a hook-shaped limiting member is arranged adjacent to the distal end of the second inserting portion, the limiting member is arranged along the contour of the second inserting portion, the diameter of the limiting member is greater than the diameter of the first central hole of the elastic body, the limiting portion hooks the annular step of the bottom end surface of the elastic body.

18. The electronic cigarette as described in claim 17, wherein the middle of the sidewall of the second inserting portion recesses to define a groove, the groove extends from the end surface of the second inserting portion to the top end surface of the limiting portion in a direction parallel to the axis of the second inserting portion, and extends laterally and upwardly through the second inserting portion and the limiting portion.

* * * * *